United States Patent [19]

Cashion

[11] 4,289,293

[45] Sep. 15, 1981

[54] COMBINATION BED CONCRETE CASTING APPARATUS

[75] Inventor: Jerry L. Cashion, Nashville, Tenn.

[73] Assignee: Span-Deck, Inc., Franklin, Tenn.

[21] Appl. No.: 83,993

[22] PCT Filed: Sep. 7, 1979

[86] PCT No.: PCT/US79/00707

§ 371 Date: Sep. 7, 1979

§ 102(e) Date: Sep. 7, 1979

[87] PCT Pub. No.: WO80/00673

PCT Pub. Date: Apr. 17, 1980

Related U.S. Application Data

[63] Continuation-in-part of Ser. No. 947,866, Oct. 2, 1978, abandoned.

[51] Int. Cl.[3] ..... B28B 7/02

[52] U.S. Cl. ..... 249/74; 249/129; 249/130; 249/132; 249/161; 425/441

[58] Field of Search ..... 249/129, 130, 132, 161, 249/74; 425/441, 440, 443, 438

[56] References Cited

U.S. PATENT DOCUMENTS

| | | | |
|---|---|---|---|
| 703,081 | 6/1902 | Palmer | 249/162 |
| 841,136 | 1/1907 | Fisher | 425/443 |
| 1,058,170 | 4/1913 | Folden | 425/438 |
| 1,593,792 | 7/1926 | Caldwell | 249/74 |
| 2,460,167 | 1/1949 | Carlsen | 249/162 |
| 2,810,946 | 10/1957 | Garnich | 249/74 |
| 3,217,375 | 11/1965 | Kinnard | 249/50 |
| 3,523,343 | 8/1970 | Mitchell | 425/438 |
| 3,832,118 | 8/1974 | Mitchell | 425/443 |
| 4,004,874 | 1/1977 | Foster | 425/438 |

*Primary Examiner*—John Parrish

*Attorney, Agent, or Firm*—Kerkam, Stowell, Kondracki & Clarke

[57] ABSTRACT

A combination bed concrete casting apparatus (20, 122 or 200) which allows either a single relatively wider elongated slab (116 or 200) or at least two relatively narrower elongated slabs (46 and 48 or 206 and 208) to be manufactured. A casting bed is divided longitudinally along the bottom wall into sections (34 and 36 or 202 and 204) which are movable transversely relative to each other. An elongate removable intermediate form (44 or 214) is positionable between the casting bed sections in a generally parallel relationship with the side form walls to form an intermediate wall. When it is desired to cast a single concrete member (116 or 200) extending all the way from one side form wall to the other, the intermediate form (44 or 214) is removed and the casting bed sections are moved closely adjacent one another. Alternatively, if it is desired to manufacture a separate concrete member in each casting bed section, the intermediate form is positioned between the sections. The combination bed apparatus may be adapted for use in combination with either a fixed bed casting apparatus or a moving bed casting apparatus. The relative transverse movement of the casting bed sections may be accomplished either by moving both sections (34 and 36) away from a centerline, or moving one section (202) away from the other (204), which remains fixed.

20 Claims, 22 Drawing Figures

COMBINATION BED CONCRETE CASTING APPARATUS

CROSS REFERENCE TO RELATED APPLICATION

This is a continuation-in-part of copending U.S. Patent application Ser. No. 947,866, filed Oct. 2, 1978.

BACKGROUND OF THE INVENTION

The present invention relates generally to the manufacture of cast concrete structural members and, more particularly, to an improved apparatus for manufacturing such concrete members in a plurality of different widths.

To efficiently manufacture cast concrete members in the form of slabs to be used, for example, as walls, floors, or roofs in building construction, a batch-type process has been employed. In a batch-type process, a long concrete slab or plank is poured and cured, and thereafter cut into a plurality of shorter length sections. Due to the relatively long curing time required (approximately 14 hours), this batch-type process is more efficient than casting individual shorter slabs because a large number of individual planks may be produced at substantially the same time. The length of the slab before cutting into shorter lengths may be as much as 150 meters (500 feet), with the slab weighing approximately 230,000 kg. (500,000 pounds). The shorter lengths into which the slab is cut may range from approximately 2.4 meters (eight feet) long for a wall span, to 15.2 meters (fifty feet) long for a roof span. Of course, other lengths are possible, as desired.

In the above-described process, the concrete slab is prestressed by means of reinforcing strands or cables longitudinally tensioned between the ends of the casting bed prior to the casting of the concrete. After the concrete is cured, the ends of the reinforcing strands are released to transfer the stress to the concrete.

One limitation in both the manufacture and the use of precast concrete slabs relates to the capacity of cranes used to handle the slabs. Cranes are employed both at the manufacturing facility to lift the completed slabs from the casting bed onto suitable storage or transportation means, and at a construction site to lift the slabs into proper position on the building structure. For efficient use of the casting apparatus, it is desirable to cast the slabs in as wide a width as practical, for example 2.4 meters (eight feet). However, a slab 2.4 meters (eight feet) wide by 15.2 meters (fifty feet) long, such as might be employed for a roof span, may be too heavy for cranes available at a construction site to lift, while a shorter length, for example an 2.4 meter (eight foot) wide by 4.5 meter (fifteen feet) to 6.1 meter (twenty foot) long wall span, may be within the lifting capacity of the crane. Accordingly, in situations where crane capacity is limited, it is desirable to manufacture slabs of lesser width, for example 1.2 meter (four feet), where the longer lengths are being manufactured. Overall, the most efficient operation results where the widest possible slabs are manufactured for each circumstance.

It is therefore desirable to be able to manufacture such slabs in a plurality of widths, such that as the lengths of the completed slabs are varied the overall weight may be kept within the crane capacity. For example, 2.4 meter (eight foot) wide slabs may be manufactured for the shorter lengths, and 1.2 meter (four foot) wide slabs for the longer lengths. A previously employed approach to this problem has been to cast all slabs in 2.4 meter (eight foot) widths, and then saw longitudinally. While this accomplishes the desired result, it has the disadvantages of increased usage of expensive diamond toothed saw blades, and requires additional costly labor time.

By the present invention there is provided an improved apparatus for manufacturing elongated concrete structural members in a plurality of widths. Apparatus embodying the present invention is particularly adapted for use in making concrete structural members employing either a fixed bed apparatus of the general type described in the commonly-assigned U.S. Pat. No. 3,217,375 of Kinnard, or a moving bed apparatus of the type described in the commonly-assigned U.S. Pat. No. 3,523,343 of Mitchell.

In the Kinnard U.S. Pat. No. 3,217,375, the concrete structural member, including core openings therein, is produced on a stationary casting bed by means of hopper and roller units and a casting machine which travel the length of the bed. The completed member is then cured and subsequently cut into desired lengths.

The Mitchell U.S. Pat. No. 3,523,343 describes a moving bed system wherein a manufacturing area contains sequentially used items of production equipment suitably housed and located centrally between an elongated curing area and a similarly elongated unloading overrun area. A casting bed moves back and forth several times during each production cycle while the various operations of the manufacturing process are performed. The casting bed comprises a lengthy stress frame which is mounted on a track extending the full length of the facility and carries a molding form in which the concrete member is cast by equipment which normally remains stationary in the manufacturing area while the bed moves beneath it. The casting bed is moved along a track at any desired speed in either direction by suitable driving means such as two sets of selectively operable hydraulic motors which are located on opposite sides of the manufacturing area and which drive rubber tired wheels having frictional engagment with the stress frame.

SUMMARY OF THE INVENTION

Accordingly, it is an object of the invention to provide an improved combination bed apparatus for manufacturing elongated concrete structural members in a plurality of widths.

It is another object of the invention to provide such apparatus which avoids the need for a sawing operation along the length of a cast slab in the order of 500 feet (152 m.).

It is still another object of the invention to provide such a combination bed apparatus which allows the manufacture of either a single relatively wider elongated slab or a plurality of relatively narrower elongated slabs in substantially the same amount of time.

Briefly stated, and in accordance with one aspect of the invention, such an apparatus includes an elongated horizontal casting bed having longitudinally extending bottom and side form walls. The casting bed is divided longitudinally along the bottom wall into longitudinally extending sections which are movable transversely to the axis of the bed and relative to each other. In a preferred embodiment, the bottom wall is divided along the center thereof, and the resulting two sections are symmetrical about a center line. Additionally, there is an elongated removable intermediate form which is positionable between the casting bed sections in a generally parallel relationship with the side form walls. When it is desired to cast a single concrete member extending all the way from one side form wall to the other, the intermediate form is removed and the casting bed sections are moved closely adjacent to one another. The casting and curing operations then proceed as described in either of the above-mentioned Kinnard and Mitchell patents. Alternatively, if it is desired to manufacture a separate concrete member in each casting bed section, the intermediate form is positioned between the casting bed sections. Concrete is then poured and cured in the two bed sections. Upon completion of the curing process, the intermediate form is removed, and the two narrower slabs cut into sections of the desired lengths.

Briefly stated, and in accordance with another aspect of the invention, there are a plurality of spaced transverse tracks disposed below the casting bed perpendicular to the longitudinal dimension of the bed. To support the bed sections during relative transverse movement, a plurality of wheels are rotationally mounted to the undersides of the casting bed sections in rolling engagment with the transverse tracks.

In accordance with still another aspect of the invention, a means for transversely moving the casting bed sections includes an elongated actuator element extending along substantially the entire length of the casting bed, preferably along the center thereof, and mounted for longitudinal, but not lateral, movement. A plurality of swing arms extend laterally and symmetrically from the actuator element to both of the casting bed sections. A hydraulic actuating means is provided for longitudinally moving the actuator element to produce resultant transverse movement of the casting bed sections.

In accordance with a further aspect of the invention, to raise and lower the intermediate form, a plurality of vertical swing arms are pivotally attached between the intermediate form and a plurality of anchor members such that longitudal movement of the intermediate form produces a resultant vertical movement of the longitudinal form.

In yet another embodiment of the invention, only one of the casting bed sections is movable, while the other is fixed. However, the sections are still movable transversely relative to each other.

As previsouly stated, apparatus of the invention may be employed for example, in combination with either the apparatus described in the Kinnard U.S. Pat. No. 3,217,375 or the Mitchell U.S. Pat. No. 3,523,343, the subject matter of which is hereby incorporated by reference.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION OF THE PREFERRED EMBODIMENTS

Figure 1:
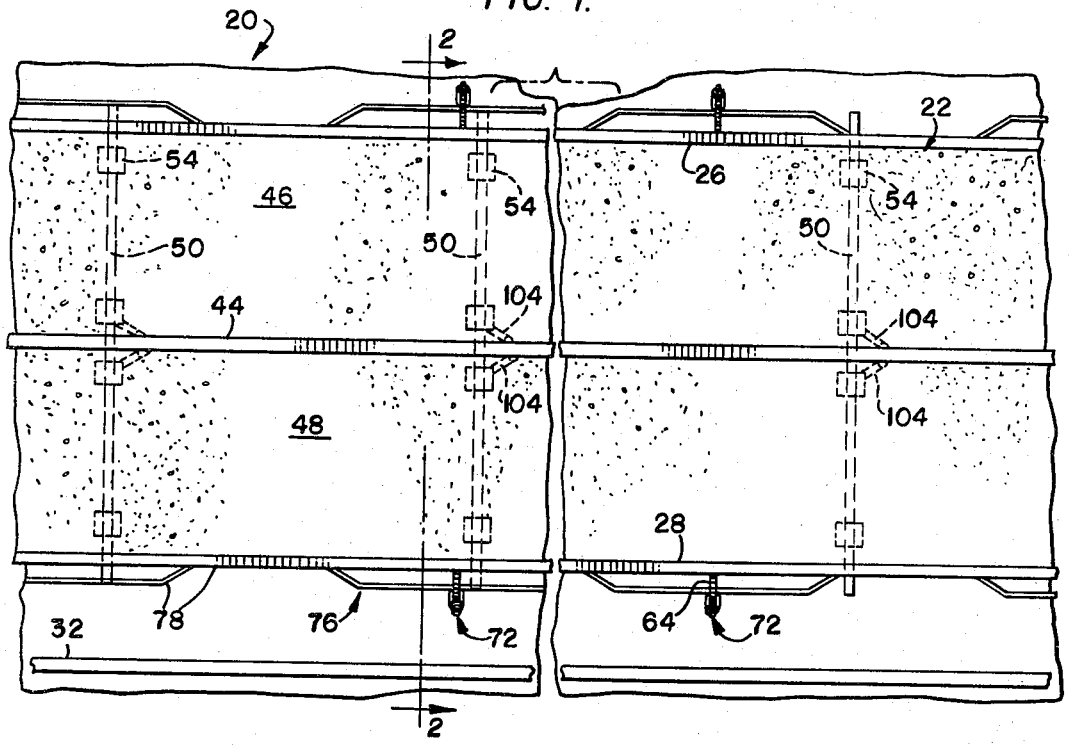
FIG. 1 is a top plan view of a fixed bed apparatus according to a first embodiment of the invention showing the casting of a pair of relatively narrower slabs.
Figure 2:
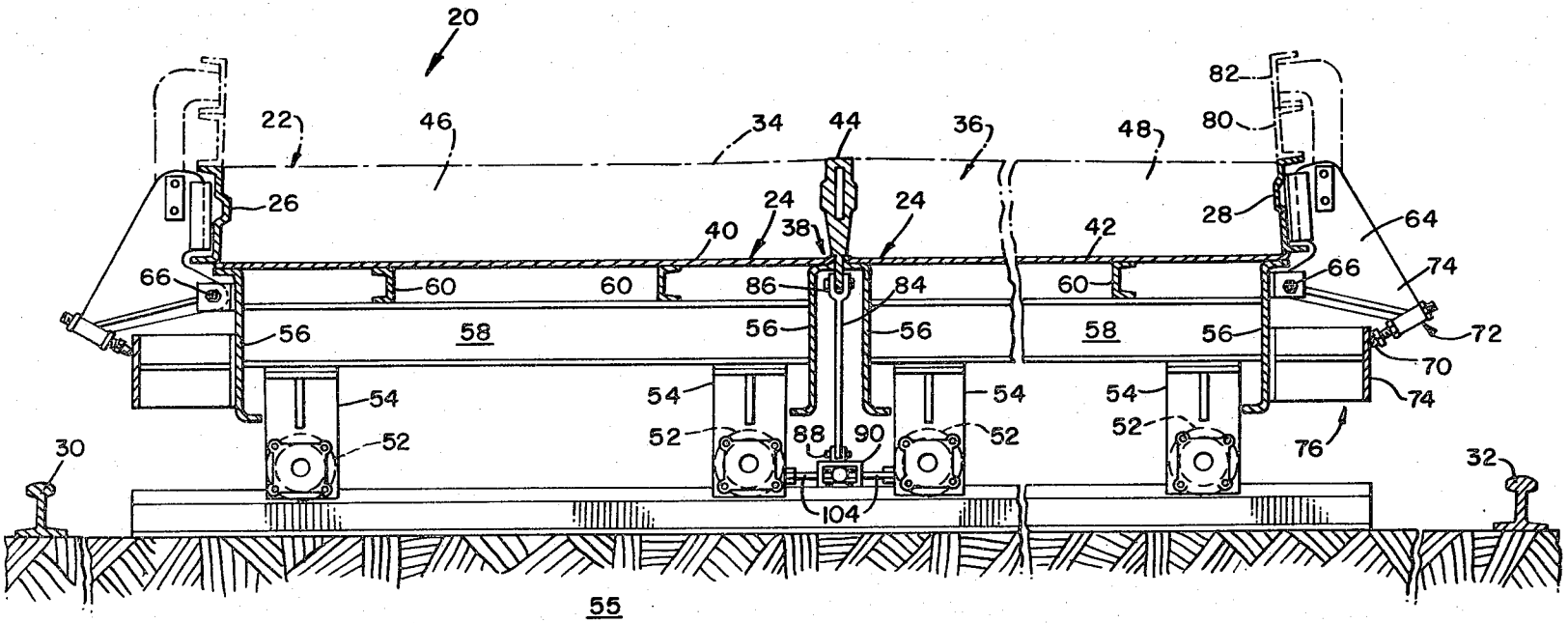
FIG. 2 is an enlarged vertical section taken along line 2—2 of FIG. 1.

Referring first to FIGS. 1 and 2, there is illustrated a stationary bed apparatus of the general type disclosed in the above-mentioned Kinnard U.S. Pat. No. 3,217,375, the entire disclosure of which is hereby incorporated by reference. The apparatus includes an enlongated horizontal casting bed 22 having a longitudinally extending bottom wall 24 and longitudinally extending left and right side form walls 26 and 28.

As described in detail in the Kinnard U.S. Pat. No. 3,217,375, a trackway comprises longitudinally extending rails 30 and 32 which support the various units (not shown) such as casting and cutting units which travel the length of the casting bed 22.

In accordance with the present invention, the casting bed 22 is divided longitudinally along the bottom wall 24 into sections moveable transversely relative to one another. In the illustrated embodiments, there are two such sections designated 34 and 36, and the bottom wall 24 is divided at 38 in the center thereof to form separate bottom wall sections 40 and 42. An elongated, removable intermediate form 44 is provided which is positionable between the two casting bed sections 34 and 36, generally parallel to the side form walls 26 and 28.

In the configuration illustrated in FIGS. 1 and 2 where the intermediate form 44 is in place, separate concrete members 46 and 48 may be manufactured in the bed sections 34 and 36. When the intermediate form 44 is removed in the manner hereinafter described in greater detail, and the casting bed sections 34 and 36 moved closely adjacent one another so that the bottom walls 40 and 42 thereof join to form a substantially continuous bottom wall, a single concrete member extending from one side to form wall 26 to the other side form wall 28 may be manufactured. In either case, the cast concrete members are manufactured according to the process described in the Kinnard U.S. Pat. No. 3,217,375. The reinforced slab or plank produced by this process may be formed by means of a plurality of operations utilizing a separate soffit laying unit and a main casting machine, all as is more fully described in the above-mentioned Kinnard Patent.

To accommodate relative transverse movement of the casting bed sections 34 and 36, a plurality of spaced transverse tracks 50 are disposed below the casting bed 22 perpendicular to the longitudinal dimension of the bed 22. The transverse rails 50 may be spaced, for example, at intervals of six meter (twenty feet), along the entire length of the casting bed 22. As mentioned above in the Background of the Invention, the length of the casting bed 22 is in the order of 150 meters (five hundred feet). A plurality of grooved wheels 52 are rotationally mounted to the undersides of the casting bed sections 34 and 36 in rolling engagement with the transverse tracks 50 so as to support the bed sections 34 and 36 during relative transverse movement thereof. More particularly, each of the wheels 52 is mounted by suitable bearing means within a wheel housing 54 secured generally to the undersides of the sections 34 and 36. As shown, the axes of the grooved wheels 52 are parallel to the longitudinal dimension of the casting bed 22.

Since the apparatus 20 of FIGS. 1 and 2 is a fixed bed apparatus, the longitudinal rails 30 and 32 and the spaced transverse rails 50 are firmly fixed to the ground via a concrete base 55.

Due to the relatively wide six meter (twenty foot) spacing between the transverse rails 50 and the extreme weight of the cast concrete members, it will be apparent that a substantial support structure is required to avoid objectionable sagging between the support points comprising the transverse rails 50 and the wheels 52 with associated housings 54. To this end, Z beams 56 extend along the sides of the casting bed sections 34 and 36 below the side edges of the bottom wall sections 40 and 42. While the Z beams 56 run continuously along the entire length of the casting bed 22, they may comprise individual sections approximately twelve meters (40 feet) long suitably joined together. Extending transversely between the Z beams 56 are a plurality of I beams 58 spaced approximately 0.75 meter (2.5 feet) apart along the length of the casting bed 22. Finally, to support the bottom wall sections 40 and 42, beams such as C beams 60 bridge across the I beams 58.

Figure 4:
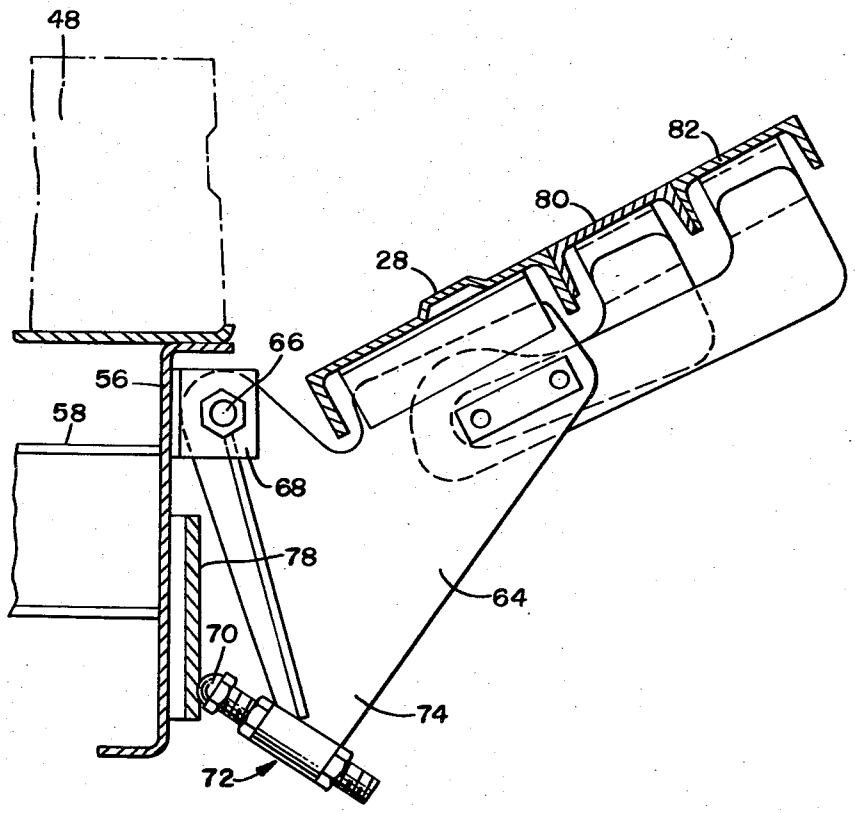
FIG. 4 is a view of the right side form of FIGS. 2 and 3 in the lowered position for sawing and removal of the cast slab.
Figure 3:
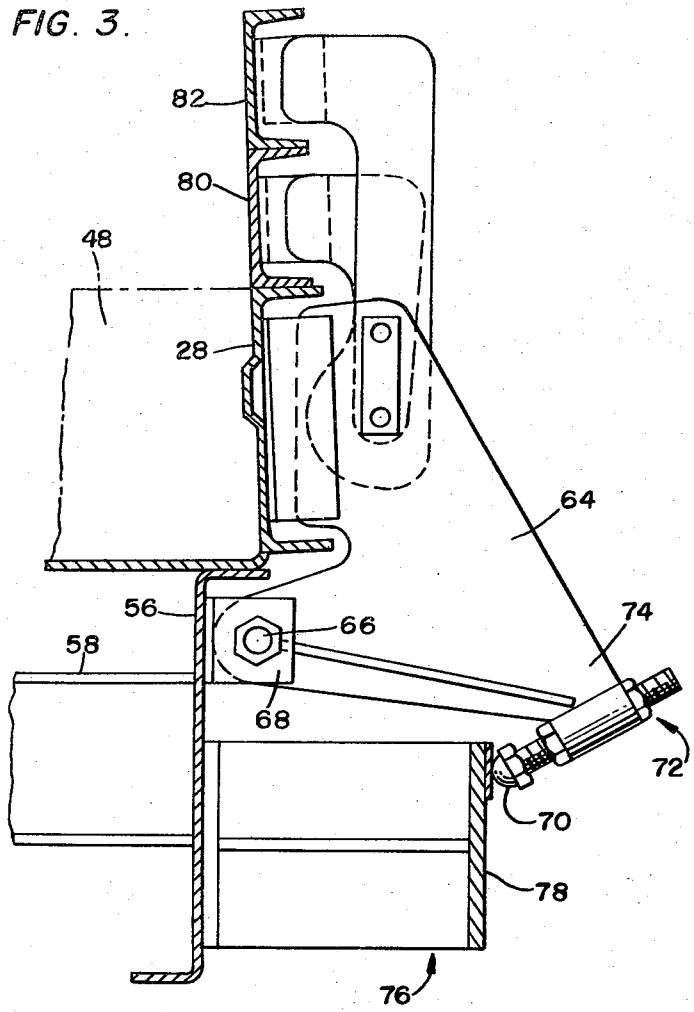
FIG. 3 is a further enlarged sectional view showing the right side form of FIG. 2 in the upright position.

Referring now in addition to FIG. 2, to FIGS. 3 and 4, the right side form wall 28 will be described. It will be apparent that the left side form wall 26 is a mirror image, and identical reference numerals are applied thereto. Moveable side form walls are well known in the prior art and the illustrated embodiment is merely intended to provide one suitable example. It will be apparent therefore that the precise details of the side form walls 26 and 28 are not critical to the present invention.

The right side form wall 28 has a side form actuator 64 in the form of a plate of generally triangular configuration having a pivot point 66 mounted to the Z bar 56 disposed generally below the right side form wall 28 by means of a suitable bracket 68. The right side form wall 28 is suitably attached such as by bolting to the upper portion of the actuator 64. A sliding cam member 70 is attached via a screw type adjustment mechanism 72 to the tail portion 74 of the actuator 64.

In order to force the actuator 64 and right side form wall 28 upright into the position of FIGS. 1, 2 and 3, a cam actuator 76 extends along the length of the casting bed 22 along the side thereof. The cam actuator 76 has an outer surface 78 of varying width, as best seen in FIG. 1. The cam actuator 76 is movable longitudinally relative to the casting bed 22, and is pulled and pushed by means of hydraulic actuating cylinders (not shown) located the ends thereof.

For lowering the side form wall 28, to the position illustrated in FIG. 4, the cam actuator 76 is pulled to a position where one of the low portions of the outer surface 28 engages the sliding cam member 70, allowing the actuator 64 and right side form wall 28 to fall away. In most cases the side form wall 28 and actuator 64 will not fall away on their own accord, but will do so after being struck.

Still referring to FIGS. 3 and 4, side wall extension members 80 and 82 are shown which may optionally be added to the right side form wall 28 when it is desired to cast thicker slabs. The extension members 80 and 82 are also shown in phantom lines in FIG. 2. Although not illustrated it will be apparent that where it is desired to manufacture a pair of relatively narrower thicker slabs, an extension member (not shown) will also be required on the intermediate form 44.

Figure 5:
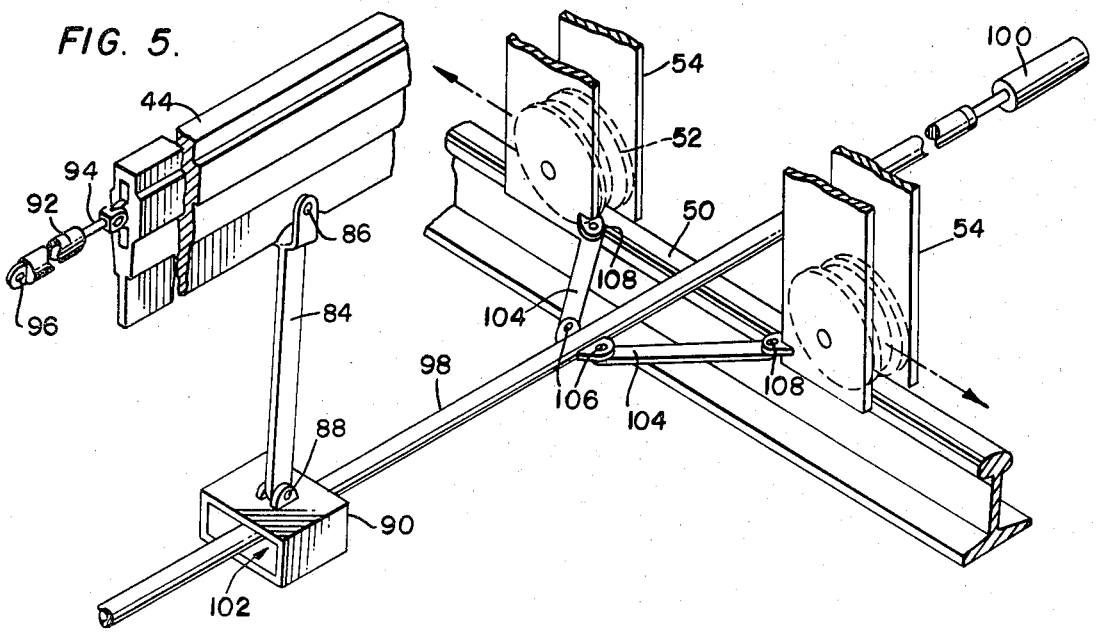
FIG. 5 is a fragmentary perspective view showing the swing arm mechanisms for raising and lowering the intermediate form and for transversely moving the casting bed sections in the apparatus of FIGS. 1 and 2.

Referring now to FIG. 5, there are shown details of the mechanism according to the invention for raising and lowering the intermediate form 44 and for transversely moving the casting bed sections 34 and 36 of the first embodiment of the apparatus 20 of FIGS. 1 and 2.

Considering first the intermediate form 44, the intermediate form 44 is mounted for vertical movement by means of a plurality of vertical swing arms, one of which swing arms is designated 84 in FIG. 5. The upper end of the vertical swing arm 84 is pivotally attached at 86 to the intermediate form 44, and the lower end of the swing arm 84 is pivotally attached at 88 and one of a plurality of anchor members 90.

In the first embodiment of the apparatus 20, which is a fixed bed apparatus, the anchor members 90 are firmly fixed relative to the ground. There is additionally provided a means for longitudinally moving the intermediate form 44, which means may comprise an hydraulic cylinder 92 located at either or both ends of the intermediate form 44. The hydraulically actuated cylinder is pivotally attached at 94 to the intermediate form 44, and at 96 to a suitable fixed support (not shown).

It will be apparent that longitudinal movement of the form 44 effected by extension and retraction of the hydraulic cylinder 92 produces a resultant vertical movement of the intermediate form 44 as the vertical swing arm 84 pivots about the point 88. As shown in FIG. 5, the intermediate form 44 is raised to nearly its fully upright position wherein the bottom of the form 44 is above the bottom wall 24 (FIG. 2) of the casting bed 22. In the fully lowered position which occurs when the intermediate form 44 is moved to the right and downward as shown in FIG. 5, the top of the intermediate form 44 is below the casting bed bottom wall 24.

Still referring to FIG. 5, the means for transversely moving the casting bed sections 34 and 36 of the first embodiment of the apparatus 20 includes an elongated actuator element 98 in the form of a length of steel tubing. The acutator element 98 extends along substantially the entire length of the casting bed 22, and is mounted for longitudinal, but not lateral movement. In order to longitudinally move the actuator element 98, a hydraulically actuated cylinder 100 is mounted at one end thereof. Preferably, the elongated actuator element 98 extends along substantially the center of the casting bed 22, just above the spaced transverse rails 50. In order to avoid interference between the actuator element 98 and the vertical swing arm anchor members 90, the anchor members 90 have passageways 102 through which the actuator element 98 freely passes. If desired, the passageways 102 may include bearings or bushings for securing the actuator element 98 against lateral movement.

To convert longitudinal movement of the elongated actuator element 98 to resultant transverse relative movement of the casting bed sections 34 and 36, swing arms 104 extend between the actuator element 98 and the casting bed sections 34 and 36. The swing arms 104 are each pivotally attached at one end 106 to the actuator element 98, and at their other ends 108 to the casting bed sections 34 and 36. In the illustrated embodiments, the pivotal attachments 108 to the casting bed sections 34 and 36 are conveniently made to suitable tabs attached directly to the wheel housings 54.

In the illustrated arrangement with the actuator element 98 extending along substantially the center of the casting bed 22 and the swing arms 104 extending laterally and symmetrically from the actuator element 98 to the casting bed sections 34 and 36, it will be apparent that the lateral forces acting on the actuator element 98 are substantially in balance so there is minimal tendency towards lateral movement thereof. From FIG. 5, it will be apparent that longitudinal movement of the actuator element caused by operation of the hydraulic cylinder 100 produces a resultant transverse movement of the casting bed sections 34 and 36.

Figure 6:
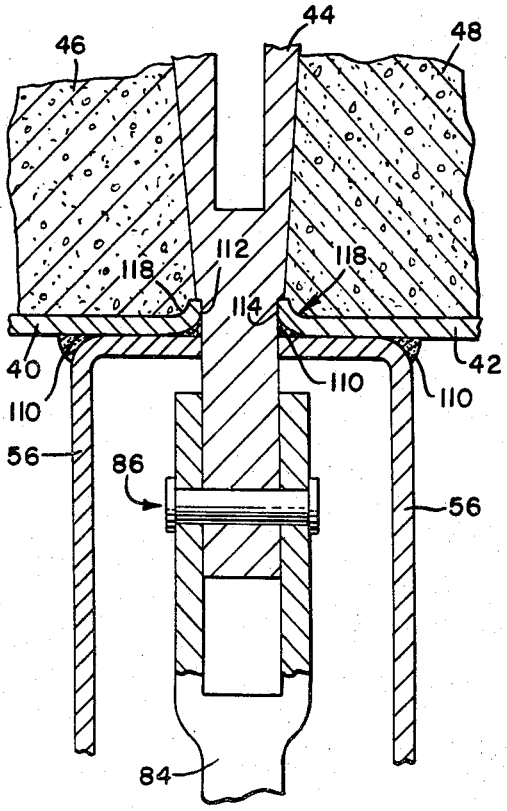
FIG. 6 is a greatly enlarged sectional view showing details of the interface between the intermediate form and the bottoms of the bed sections in the embodiment of FIG. 2.
Figure 7:
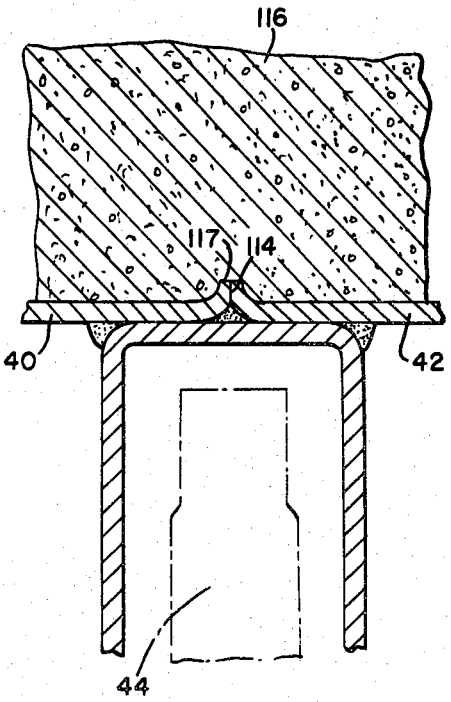
FIG. 7 is a view similar to FIG. 6 where the intermediate form has been removed and the casting bed sections moved closely adjacent one another to produce a single relatively wider slab.

FIGS. 6 and 7 show the region of interface between the bottom wall sections 40 and 42 with the intermediate form 44 respectively in place and removed. FIGS. 6 and 7, being enlarged views, also illustrate welds 110 which join the bottom wall sections 42 and 44 to the Z beams 56.

Referring in particular to FIG. 6, the intermediate form 44 is positioned between the casting bed sections 34 and 36, and more particularly between confronting edges 112 and 114 of the bottom wall sections 40 and 42. Thus individual concrete members 46 and 48 may be manufactured in the two casting bed sections 34 and 36.

In FIG. 7, the intermediate form 44 is effectively removed from its position between the casting bed sections 34 and 36 by being lowered below the bottom wall sections 40 and 42. In this view, the casting bed sections 34 and 36 are moved closely adjacent one another so the the confronting edges 112 and 114 of the bottom wall sections 40 and 42 cooperate to form an effective seal against the leakage of uncured concrete material. Thus, in this configuration a single concrete member 116 extending from one of the side form walls 26 and 28 of FIG. 2 to the other may be manufactured.

In FIGS. 6 and 7, it will be observed that the bottom wall sections 40 and 42 are curved upward in the vicinity of their confronting edges 112 and 114. When a pair of slabs 46 and 48 are produced as in FIG. 6, this curvature produces curved bottom edges at 118 on the slabs 46 and 48. Where a single slab 116 is produced as in FIG. 7, this curvature produces a channel 120 which serves an appearance function upon ultimate installation of the slabs by making it difficult to distinguish an interface between two narrower slabs and the midpoint of a wider slab. This is advantageous in those instances where the total width of the building structure concerned is equal to the combined widths of an odd number of relatively narrower concrete structural members and relatively shorter lengths are required. In such a situation, full width structural members are within the lifting capacity of the crane, but at least one half width section is required to fit the dimensions of the building structure.

Before proceeding with a description of alternative embodiments of the invention, the operation of the first embodiment 20 which has been described with reference to FIGS. 1 through 7 will now be summarized. It will be assumed that relatively narrower structural members are being produced. Following the casting of one batch, the cured slabs 46 and 48 are in their position as shown in FIGS. 1, 2 and 6. The cam actuators 76 at the sides of the casting bed 22 are pulled longitudinally to release the actuators 64 and the left and right side form walls 26 and 28 the side form walls 26 and 28 are allowed to fall away by pivoting about the points 66 to assume the position shown in FIG. 4. As previously mentioned, a blow such as kick may be required to release the side form walls 26 and 28.

At this point, the hydraulic cylinder 100 at the end of the elongated actuator element 98 is operated to separate the casting bed sections 34 and 36 through operation of the swing arms 104. The intermediate form 44 is then lowered below the level of the bottom wall sections 40 and 42 by allowing the hydraulic cylinder 92 to extend. At this point, the slabs 46 and 48 are sitting freely on top of the bottom walls 40 and 42, and may be transversely sawed into sections of desired lengths in the manner more fully described in the Kinnard U.S. Pat. No. 3,217,375. It will be appreciated that the lowering of the intermediate form 44 and the pivoting away of the side form members 26 and 28 provides clearance for the circular saw blade employed.

Following the sawing operation, the individual slab lengths are lifted by crane out of the casting bed sections 34 and 36 and transported to a storage area or to a vehicle.

To begin the next batch, the side forms 26 and 28 are raised by operating the cam actuators 76, and the intermediate form 44 is raised by operating the hydraulic cylinder 92. The intermediate form 44 is properly positioned between the casting bed sections 34 and 36, and the casting bed sections 34 and 36 are moved together to seal against the intermediate form 44 as shown in FIGS. 2 and 6. At this point, the bed sections 34 and 36 are cleaned and oiled in preparation for receiving a new batch of concrete. Concrete is poured as described in the Kinnard U.S. Pat. No. 3,217,375, and the cycle continues.

It will be appreciated that in the event full width slabs are being manufactured, the intermediate form raising and bed separating mechanisms shown particularly in FIG. 5 are not used, and the operation proceeds simply as a single bed apparatus.

Figure 8:
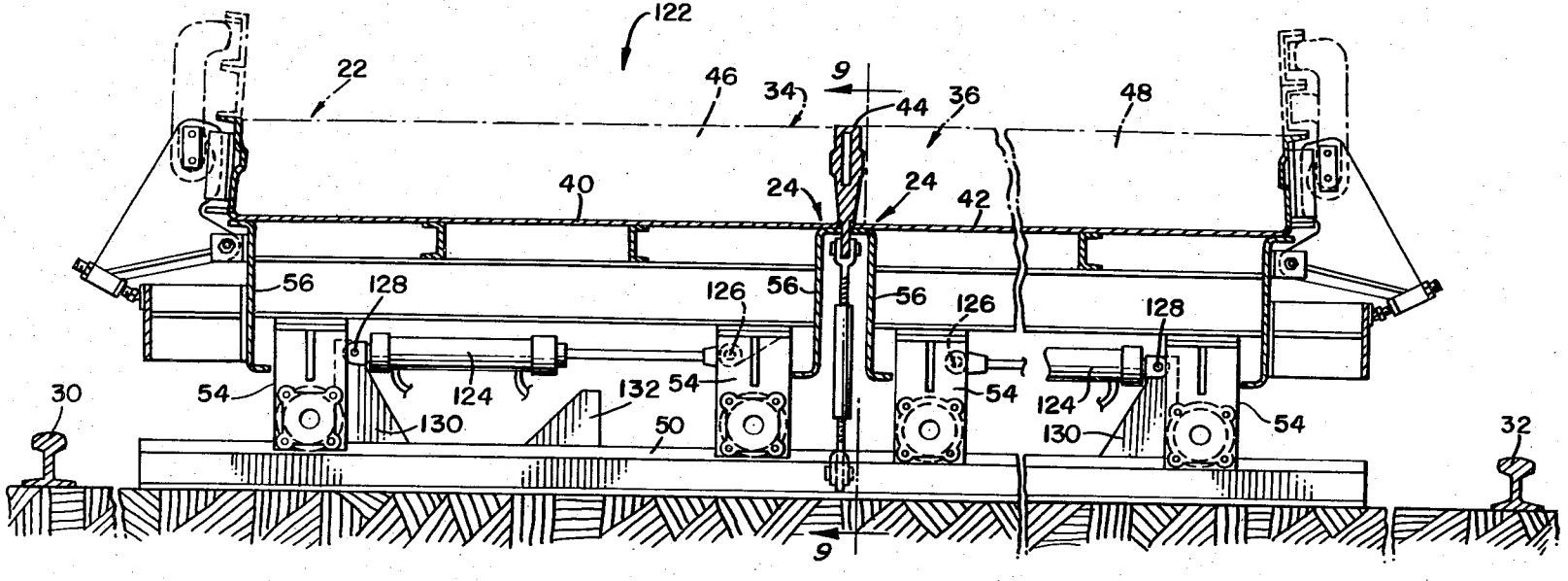
FIG. 8 is a vertical section similar to FIG. 2 showing a second embodiment of the invention employing hydraulic cylinders for transverse movement and separation of the casting bed sections.

Referring now to FIG. 8, there is shown a second embodiment of the invention embodied in an apparatus 122. The apparatus 122 is a modification to the previously-described apparatus 20, and a number of elements which are unchanged are designated by identical reference numerals. The apparatus 122 of FIG. 8 is also a fixed bed apparatus as generally disclosed in the Kinnard U.S. Pat. No. 3,217,375 and accordingly includes the longitudinal rails 30 and 32 for movement of the various items of equipment along the casting bed 22.

The primary difference in the FIG. 8 embodiment is in the means for transversely moving the casting bed sections 34 and 36 relative to each other. The apparatus 122 of FIG. 8 still has the spaced transverse rails 50 and the grooved wheels 52 for supporting the bed sections 34 and 36 and accommodating transverse movement thereof. However, instead of the elongated actuator element 98 and the swing arms 104, laterally extending hydraulically actuating cylinders 124 are employed. One end of each of the cylinders 124 is connected to the casting bed sections 34 and 36, preferably to the wheel housings 54 at attachment points 126. The other ends of the hydraulic cylinders 124 are attached at points 128 to gusset like supports 130 which, for the fixed bed apparatus 122, are fixed relative to the ground. Additional gusset like members 132 serve as stops to limit the transverse movement of the beds 34 and 36 by contacting the wheel housings 54.

Figure 9:
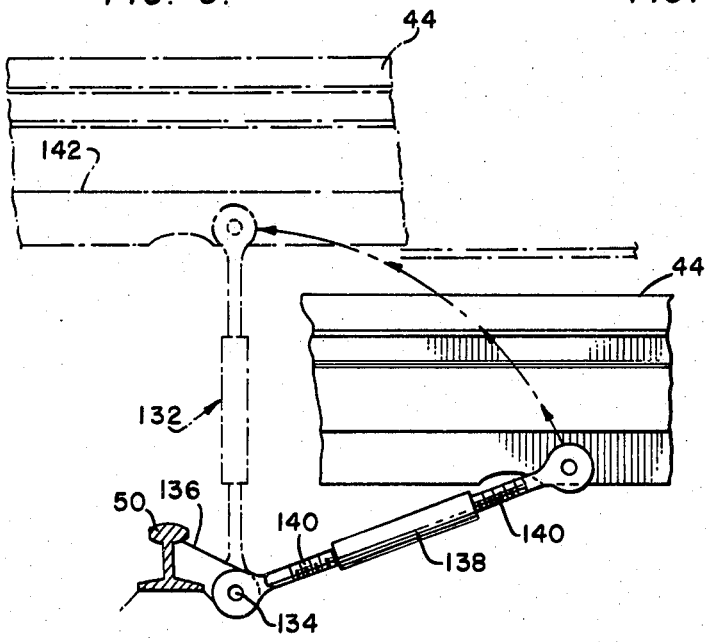
FIG. 9 is a fragmentary section taken generally along line 9—9 of FIG. 8 showing vertical movement of the intermediate form.
Figure 10:
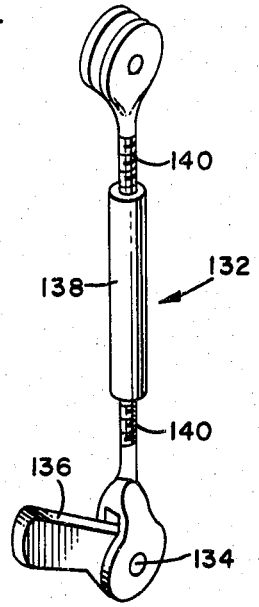
FIG. 10 is a perspective view of the vertical swing arm of the embodiment of FIGS. 8 and 9.

Referring now to FIGS. 9 and 10, there is illustrated the form of the vertical swing arms used to raise and lower the intermediate form 44 in the apparatus of FIG. 8, which form 44 is otherwise unchanged. In FIGS. 9 and 10, the anchor members 90, and specifically the passageways 102 thereof (as shown in FIG. 5) are not required. The lower ends of the modified swing arms 132 are pivotally attached at 134 to members 136 which abut the spaced transverse rails 50. Since the force on the pivot points 134 is all in one direction, the use of the abutting members 136 provide a convenient way to effectively anchor the lower ends of the swing arms 132. The upper ends of the modified swing arms 132 are connected as before to the intermediate form 44. In FIGS. 9 and 10 it will also be observed that the modified vertical swing arm 132 includes turnbuckle members 138 cooperating with threads 140 to allow length adjustment of the vertical swing arms 132.

It should be noted that FIG. 9 provides an illustration of two positions of the intermediate form 44 with reference to the bottom wall 24 of the casting bed 22. Shown in full lines is the lowered position of the intermediate form 44 which is the position where the intermediate form 44 is effectively removed. Shown in phantom lines is the full upright position used for pulling the intermediate form 44 away from the slabs 46 and 48. The position of the intermediate form 44 for casting the concrete members is not illustrated in FIG. 9, but is a position slightly below the upper position shown in phantom lines, which occurs when the transition 142 coincides with the bottom wall 24.

Figure 11:
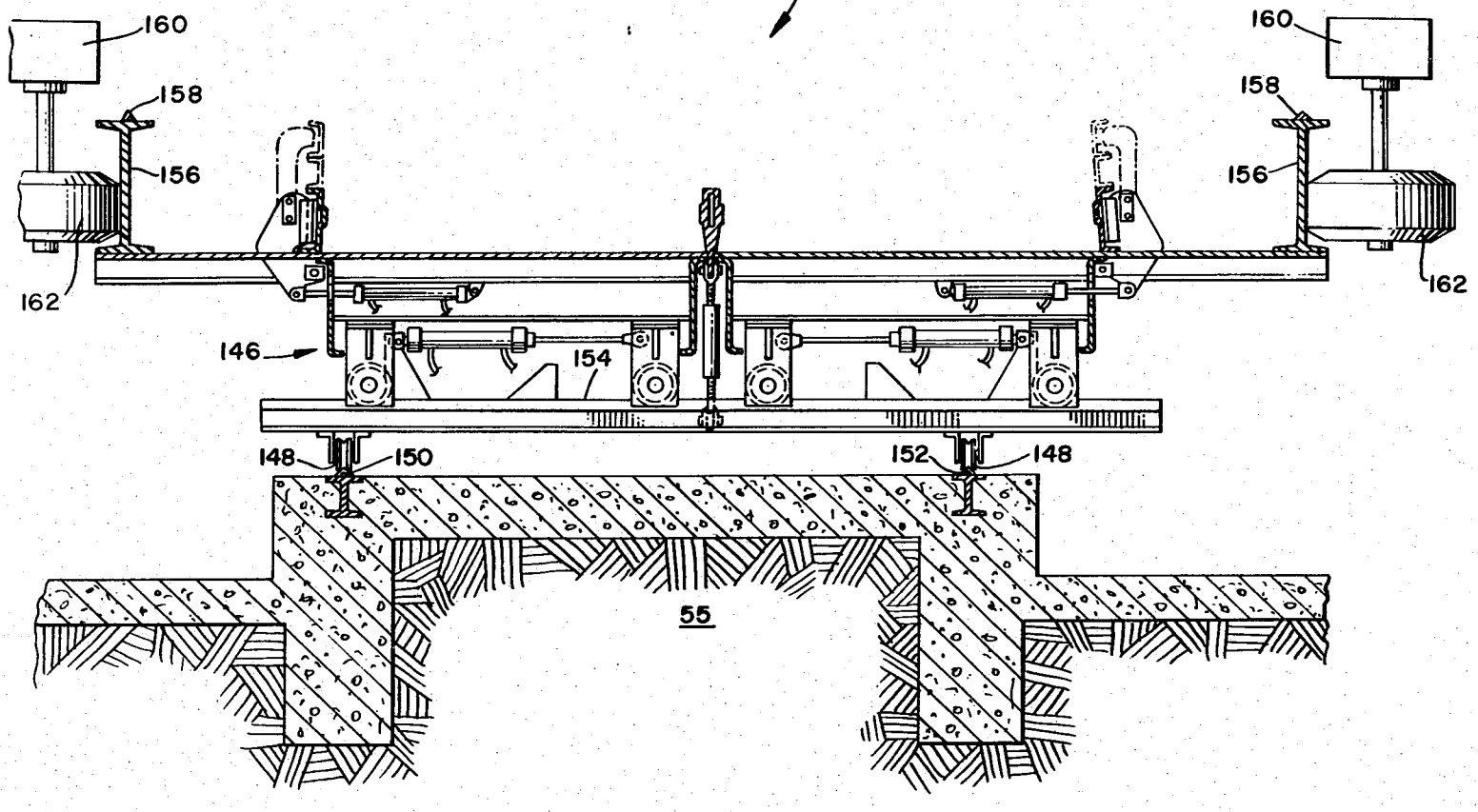
FIG. 11 is a vertical section similar to FIG. 2 showing a third embodiment of the invention applied to a moving bed apparatus.

Referring next to FIG. 11, there is shown a third embodiment of the invention embodied in an apparatus 144, which is a moving bed system as generally described in the Mitchell U.S. Pat. No. 3,523,343, the entire disclosure of which is hereby incorporated by reference. As more fully described in the Mitchell U.S. Pat. No. 3,523,343, the entire bed 146 rolls longitudinally on grooved wheels 148 riding a track comprising rails 150 and 152. Thus, instead of resting on the ground, the transverse rails 146 (corresponding to the previously-described transverse rails 50) are supported by the wheels 148. In the moving bed system, the various items of equipment generally remain stationary while the bed 146 rolls longitudinally. To support this equipment, I beam side members 156 are provided, with rails 158 at the tops thereof. As also described in the Mitchell U.S. Pat. No. 3,523,343, variable speed reversible hydraulic motors 160 having rubber drive hydraulic motors 160 having rubber drive wheels 162 frictionally engaging the sides of the I beams 156 are provided to move the bed 146.

The moving bed 146 of the apparatus 144 of FIG. 11 is otherwise essentially the same as the fixed bed 22 of the apparatus 122 of the FIG. 8 embodiment, and a detailed description thereof will not be repeated. It should be noted that the spaced transverse rails 154 are no longer fixed to the ground, but rather are attached to the housing of the wheels 148. The lower ends of the vertical swing arms 132 are attached to suitable lugs (not shown) on the rails 154. Additionally, the hydraulic cylinder 92 (FIG. 5) for operating the intermediate form 44 is not fixed to a stationary support, but rather is fixed relative to the framework of the moving bed 146.

Referring now to FIGS. 12, 13, 14 and 15, a combination bed concrete casting apparatus 200 constructed in accordance with a fourth embodiment of the invention is illustrated in highly schematic form. The casting bed 200 is divided longitudinally in two sections 202 and 204. While the sections 202 and 204 are movable transversely relative to one another as in the previous embodiments, the combination bed 200 differs from the previously-described embodiments in that only one of the sections 202 and 204 is movable relative to the ground, and the other remains fixed relative to the ground. In the illustrated embodiments, the left casting bed section 202 is movable, while the right hand casting bed section 204 is fixed. This particular arrangement is in many respects simpler to construct then the previously-described embodiments in that it minimizes the need for heavy moving elements.

Figure 12:
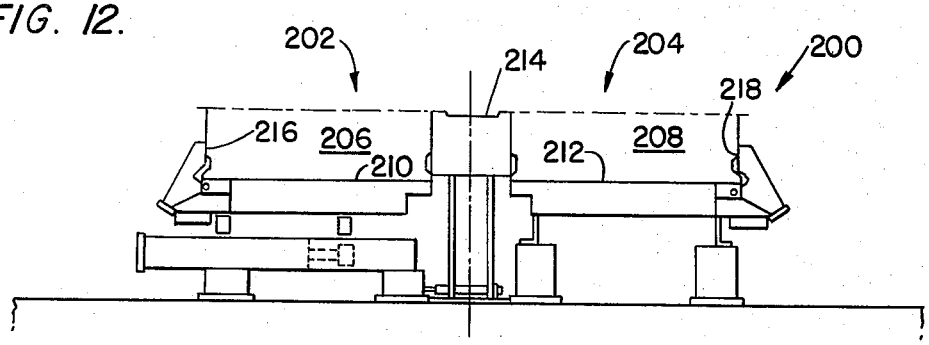
FIG. 12 is a highly schematic vertical section similar to FIG. 2 showing a fourth embodiment of the invention wherein only one of the casting bed sections moves transversely, with the other casting bed section being fixed.

In FIG. 12 may be seen a pair of separate concrete members 206 and 208 (phantom lines) molded in the apparatus 200. The concrete members 206 and 208 are supported on respective pallets 210 and 212 comprising the sections 202 and 204, are separated by an intermediate form assembly 214, and are bounded by left and right side form members 216 and 218, respectively.

The overall sequence of operations involved in manufacturing two one-half width (for example each 1.2 meters or four feet wide) concrete members 202 and 204 will now be described with particular reference to FIGS. 12, 13 and 14.

FIG. 12 illustrates the situation when the intermediate form assembly 214 and the left and right side form assemblies 216 and 218 are in position for casting and curing.

Figure 13:
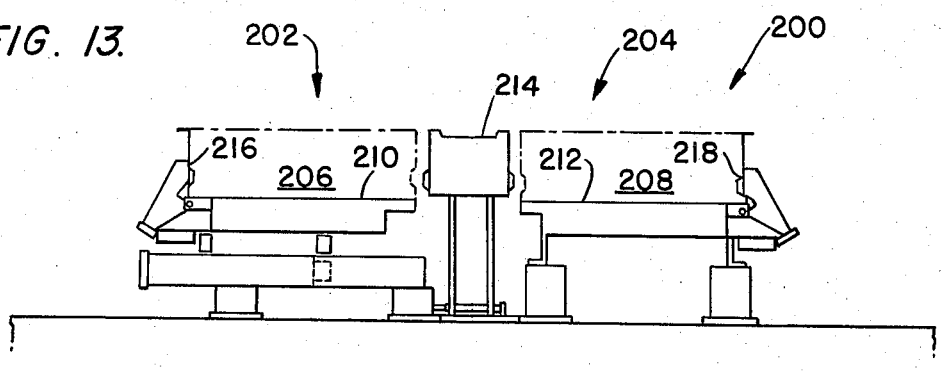
FIG. 13 is a view of the FIG. 12 embodiment showing the configuration when the left-hand casting bed section and the intermediate form assembly have moved away from the stationary right-hand casting bed section.
Figure 14:
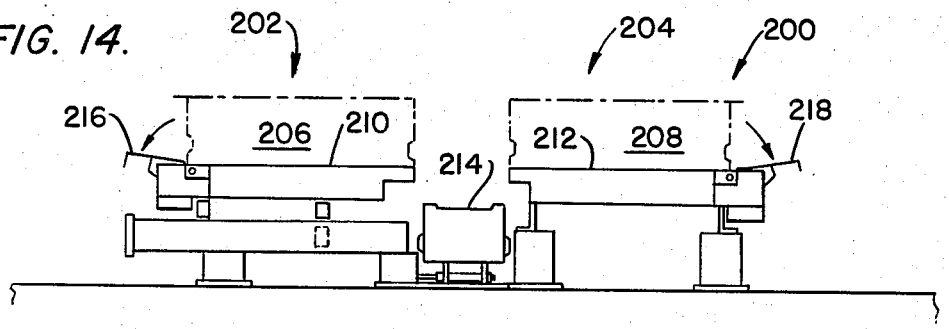
FIG. 14 is a view of the FIG. 12 embodiment showing the configuration when the intermediate form assembly is lowered and the side form assemblies are pivoted away, ready for transverse sawing and removal of the cast concrete members.

As illustrated schematically in FIG. 13, following the curing of the concrete comprising the members 206 and 208 in the same manner as previously described, the movable casting bed section 202 moves transversely to the left, away from the fixed casting bed section 204. The arrangement is such that the movable section 202 initially moves away from both the intermediate form 202 and the fixed section 204, while the intermediate form assembly 214 remains slightly adhered to the concrete member 208. At a certain point in its transverse movement, an element of the movable section 202 engages the intermediate form 202, pulling the intermediate form assembly 214 laterally away from the fixed section 204, and away from the concrete member 208. (This particular action is described in greater detail below with reference to FIG. 21).

Next, as may be seen from FIG. 14, the intermediate form assembly 214 is lowered below the pallets 210 and 212 comprising the casting bed sections 202, and the left and right side forms 216 and 218 are pivoted away. In this this configuration, the concrete slab members 206 and 208 may be sawed into sections of any desired length as previously described, and thereafter lifted out of the respective casting bed sections 202 and 204 by means of a crane.

Figure 15:
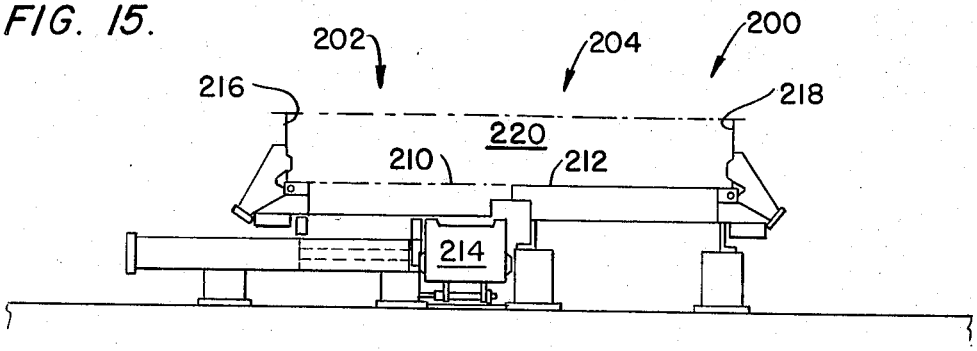
FIG. 15 is a view similar to FIG. 12 showing the FIG. 12 embodiment in a configuration for casting a single, full-width concrete slab.

FIG. 15 illustrates the configuration for casting a single full width (for example 2.4 meters or eight feet wide) concrete member 220. In the FIG. 15 configuration, the intermediate form assembly 214 remains below the pallets 210 and 212 comprising the casting bed sections 202 and 204, and the movable casting bed section 202 is closely adjacent the fixed casting bed section 204, forming in effect a single wide casting bed.

Upon the completion of a casting and curing operation to produce the single full width concrete member 220, the side form members 216 and 218 are pivoted away, and the concrete member 220 is sawed into individual slabs of desired length which are lifted out of the casting bed 200, in the manner previously described.

Figure 16:
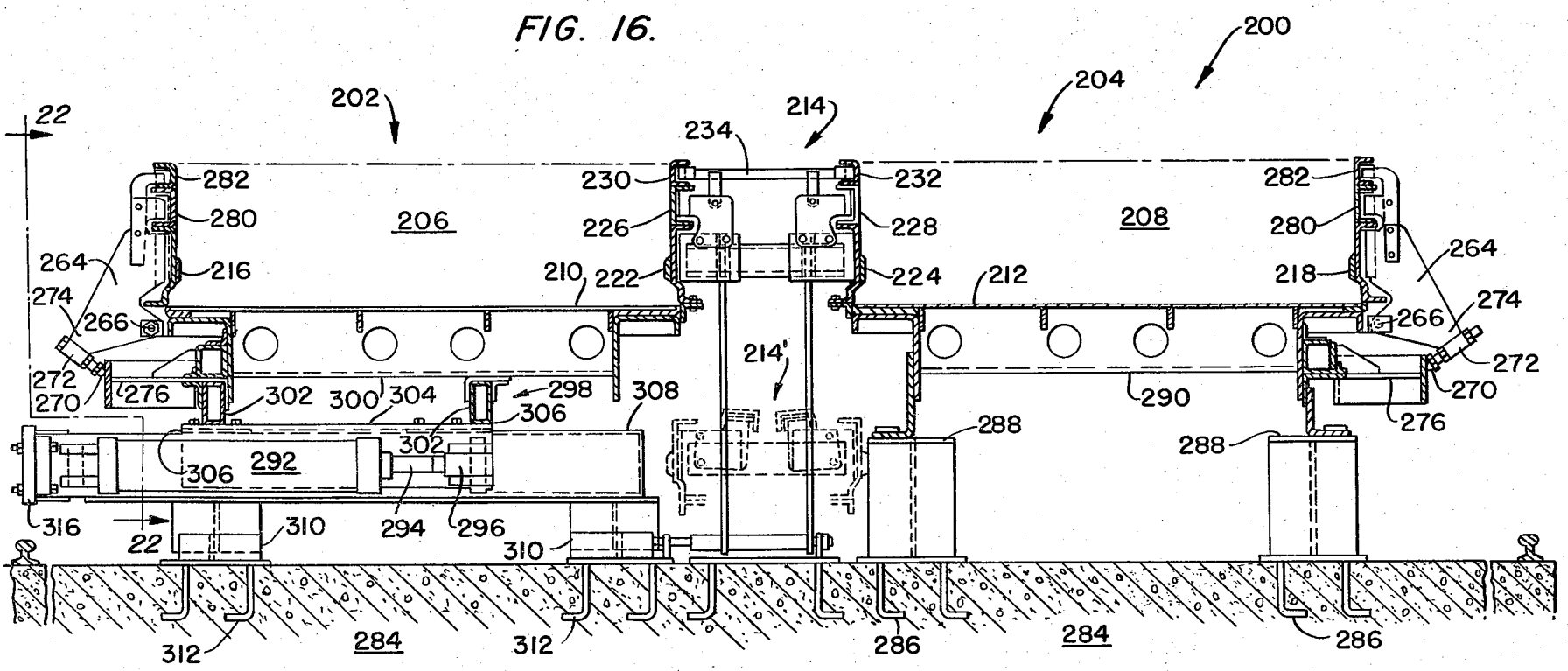
FIG. 16 is an enlarged sectional view showing the configuration of FIG. 12 in greater detail.
Figure 17:
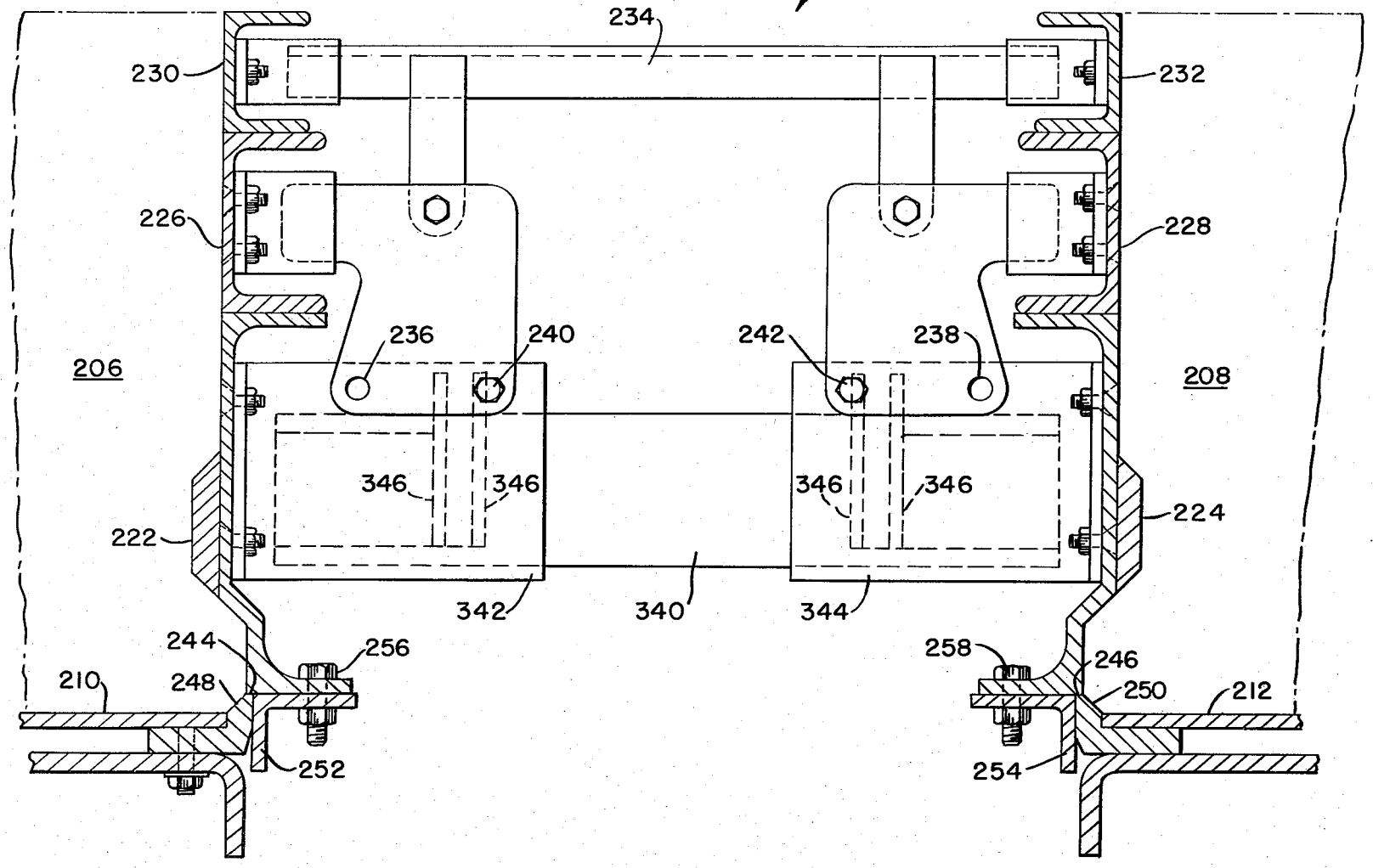
FIG. 17 is a further enlarged sectional view showing the intermediate form assembly of FIG. 18 in greater detail.

FIG. 16, which may be compared to FIG. 12, illustrates various constructional details of the apparatus 200, while FIG. 17 illustrates further details of the intermediate form assembly. The intermediate form assembly 214 comprises left and right lower sections 222 and 224, left and right middle sections 226 and 228, and left and right upper sections 230 and 232 joined by a support element 234. The lower sections 222 and 224 are permanent parts of the intermediate form assembly 214, while the sections 226, 228, 230 and 232 are optionally installed when it is desired to cast concrete slabs of greater thickness than is possible with the sections 230 and 232 alone.

Shown in phantom lines in FIG. 16 is the position of the intermediate form assembly 214' when lowered below the pallets 210 and 212 either for the purpose of permitting sawing of the concrete members 206 and 208 as in FIG. 14, or for the purpose of permitting the casting of a single full-width (2.4 meter or eight foot) concrete member. In the lowered position shown in phantom lines in FIG. 16, the intermediate form assembly top sections 230 and 232, as well as the support element 234, are removed, and the middle sections 226 and 228 are pivoted about respective pivot points 236 and 238 after removing bolts 240 and 242 (FIG. 17).

As may be best seen in FIG. 17, in the upper position of the intermediate form assembly 214, slight ledges at 244 and 246 on the intermediate form assembly 214 engage lips 248 and 250 of the respective movable and fixed pallets 210 and 214, and are supported thereby. Lateral registration of the assembly is effected by abutment of the sides of the lips 248 and 250 against downward projections 252 and 254 comprising "L" members extending from adjacent ledges 244 and 246 and attached by means of bolts 256 and 258 to the intermediate form assembly 214.

In FIG. 16, the left and right side form assemblies 216 and 218 are substantially identical to those comprising the left and right side form walls 26 and 28 described above with particular reference to FIGS. 3 and 4. As in the previous embodiments, each of the side form assemblies 216 and 218 comprises a triangular actuator 264 pivoting about a point 266 suitably affixed to the respective pallets 210 and 212. A sliding cam member 270 is attached via screw-type adjustment mechanisms 272 to tail portions 274 of the actuators 264.

In order to force the actuators 264 and the side form assemblies 212 upright into the position illustrated in FIG. 16, cam actuators 276 extend along the length of the combination bed assembly 200, as may be best seen in FIG. 22, described hereinafter. The cam actuator 276 has an outer surface of varying width. As a cam actuator 276 is moved longitudinally, the left and right side form members 212 and 214 are raised and lowered in the manner previously described.

Also as previously described, side wall extension members 280 and 282 may optionally be installed when it is desired to cast thicker concrete members. It will be appreciated that the extension members 280 correspond to the middle sections 226 and 228 of the intermediate form assembly 214, and the top extension member 282 correspond to the top sections 230 and 232 of the intermediate form assembly 214.

As mentioned above, a distinguishing characteristic of the embodiment described herein beginning with reference to FIG. 12 is that one of the two casting bed sections is immovably fixed to the ground. As may be seen in FIG. 16, in the particular arrangement illustrated, the casting bed section 204 is fixed to the ground 284 by means of embedded anchors 268, I beam supports 288 and support structure 290 generally supporting the pallet 212.

On the other hand, the casting bed section 202 is transversely (laterally) movable, with the lateral movement generally being effected by means of an hydraulic cylinder 292. Hydraulic cylinder 292 has an extending piston rod 294, the end 296 of which is affixed to a sliding assembly generally designated 298. The sliding assembly 298 comprises the pallet 210 of the movable section 202, support structure 300, including box-section beams 302, a tie member 304 extending between the box-section beams 302, and slide plates 306. This assembly 298, more particularly the slide plates 306, is slidably supported on the outer surface of a box-section beam 308 alongside the body of the hydraulic cylinder 292. The beam 308 is fixed in position by means of supports 310 attached to embedded anchors 312. The opposite end 314 of the hydraulic cylinder 292 is anchored to an attachment assembly 316 on the end of the sleeve 308, thereby ensuring that the body of the cylinder 292 does not move.

Preferably, to ease assembly tolerance requirements, the connection of the cylinder end 314 to the attachment assembly 316, as well as the attachment of the piston rod end 296 to the sliding assembly, each permit pivotal movement about a vertical axis. It is additionally preferable that a mechanical stop (not shown) be provided to prevent further retraction of the piston rod 294 into the body of the cylinder 292 beyond the position which produces the fully-open configuration of FIGS. 13 and 14.

Figure 18:
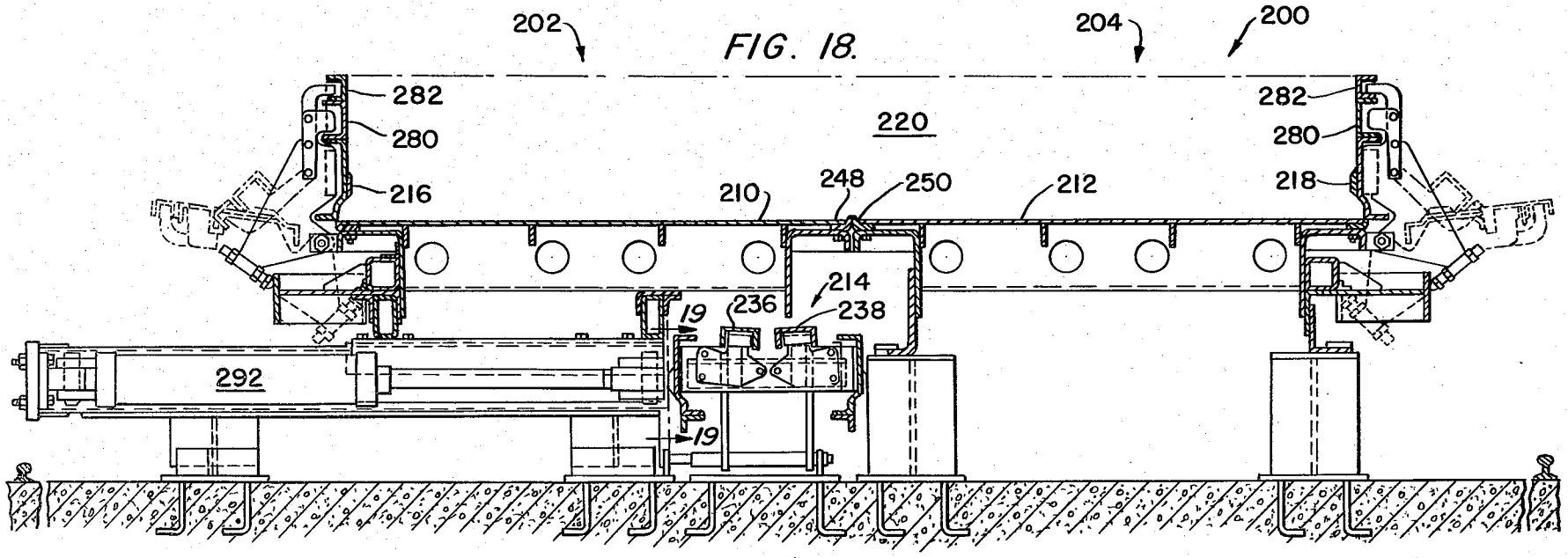
FIG. 18 is an enlarged sectional view showing the configuration of FIG. 15 in greater detail.

FIG. 18 is a detailed view similar to that of FIG. 16, but shows the piston rod 294 of the hydraulic cylinder 292 fully extended, with the two casting bed pallets 210 and 212 in abutment at their respective lips 248 and 250, thus forming a single, wide (2.4 meter or eight foot) casting bed. In this configuration, the intermediate form assembly 214 is in its lowered position, as was seen only in phantom lines in FIG. 16. In the lowered position of the intermediate form assembly 214, the top sections 230 and 232, visible in FIG. 17, have been removed, as well as the support element 234. The middle sections 236 and 238 are manually pivoted inwardly in order to fit within the available space.

In the configuration of FIG. 18, for sawing and removing of the cast concrete member 216 it is only necessary to pivot the side form members 216 and 218, in the manner previously described and as is shown in phantom lines in FIG. 18.

Figure 19:
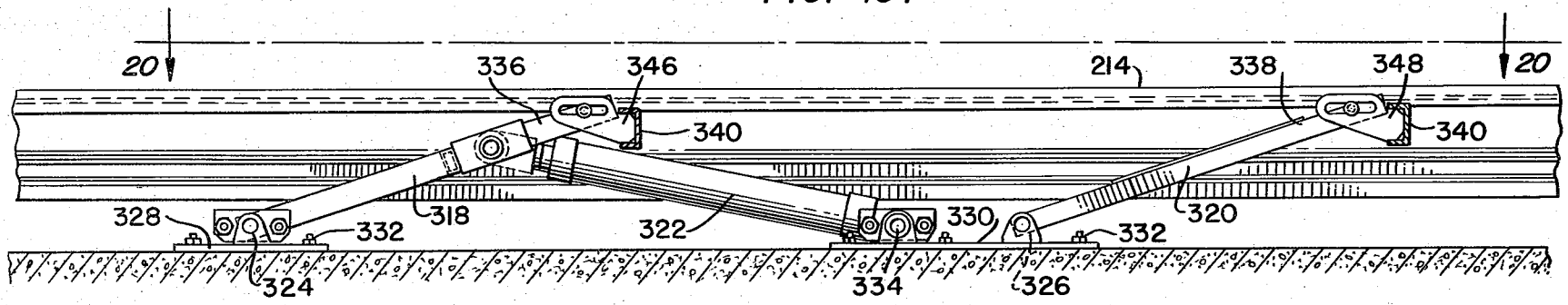
FIG. 19 is a side elevational view taken along line 19—19 of FIG. 18 showing details of the arrangement for effecting vertical movement of the intermediate form assembly.
Figure 20:
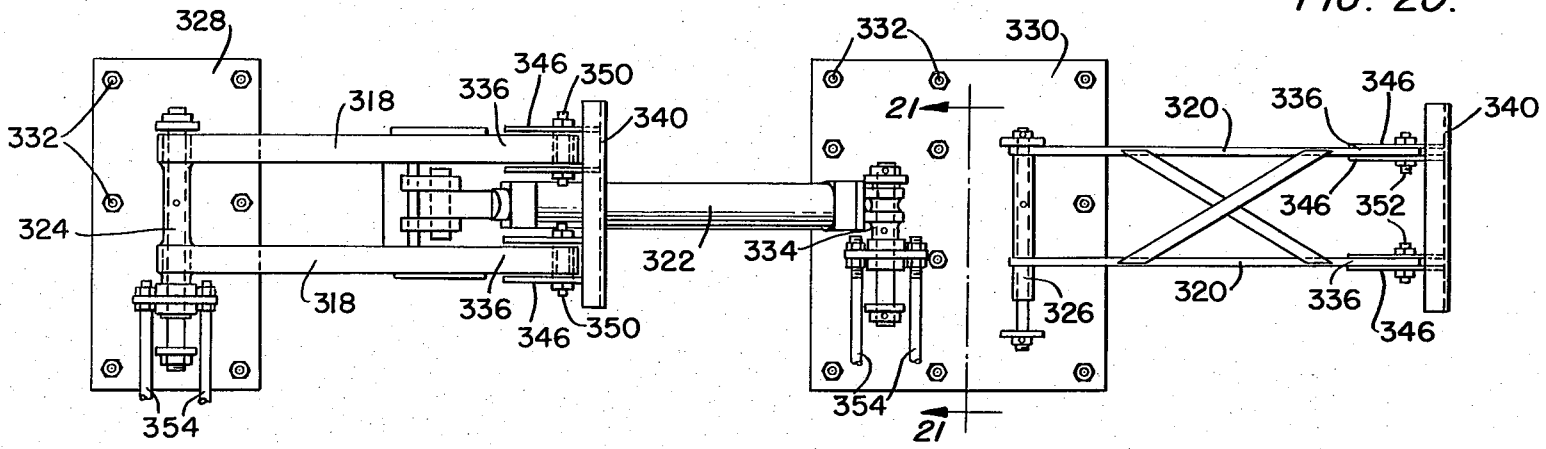
FIG. 20 is a plan view taken along line 20—20 of FIG. 19.
Figure 21:
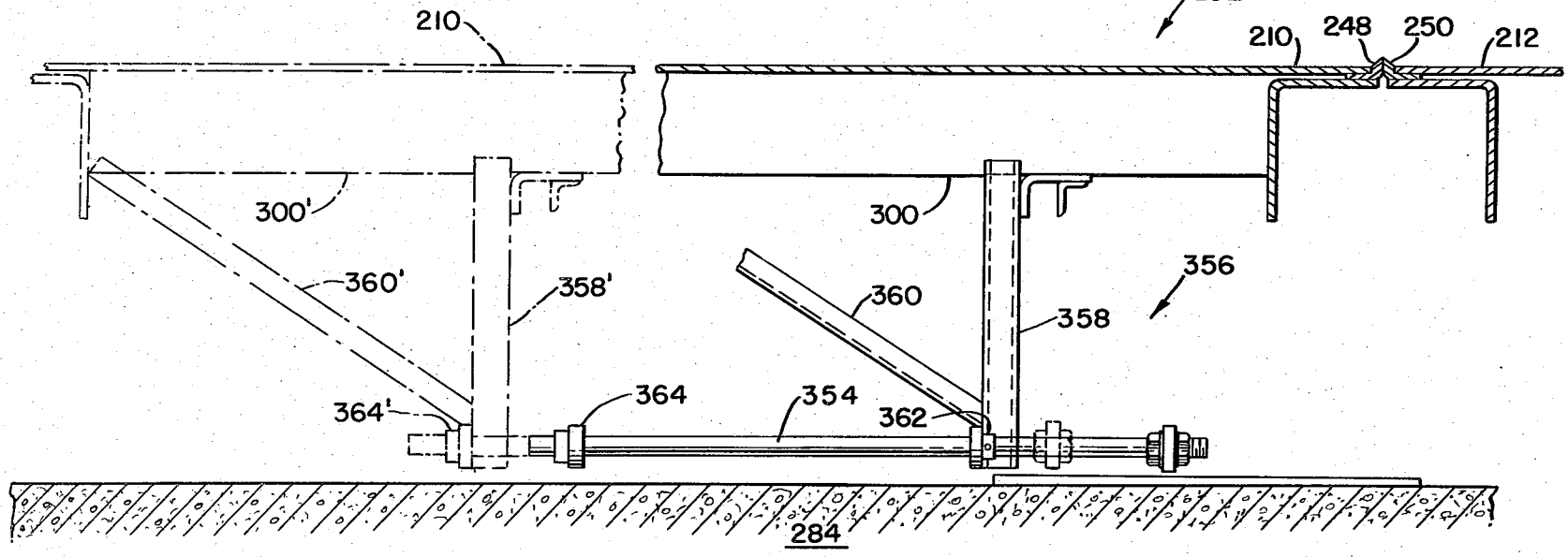
FIG. 21 is a view taken generally along line 21—21 of FIG. 20 showing the manner in which lateral movement of the intermediate form assembly away from the fixed casting bed section is effected.

With reference to FIGS. 19, 20 and 21, the manner in which both vertical and transverse movement of the intermediate form assembly 214 is accomplished will now be described.

Similar to the previously described embodiments, vertical movement of the intermediate form assembly 214 is effected by means of hydraulically actuated swing arm assemblies comprising swing arms 318 and 320, and a representative hydraulic actuating cylinder 322. The intermediate form assembly 214 extends for approximately 180 meters (600 feet), and may comprise individual sections of any suitable length. Swing arm assemblies and hydraulic actuating cylinders such as the swing arm assemblies 318 and 320 and the hydraulic actuating cylinder 322 are suitably spaced along the length of the intermediate form assembly 214. The swing arms as pivotally attached as at 324 and 326 to mounting plates 328 and 330 securely affixed to the ground 284 by means of partially embedded bolts 332. The hydraulic cylinders such as the cylinder 322 are also pivotally attached as at 334 to selected ones of the mounting plates, for example the mounting plate 330.

Not all of the swing arms need have hydraulic actuating cylinders directly attached thereto. As may be seen from FIG. 19, the representative swing arm 318 is directly hydraulically actuated, while the representative swing arm 320 passively pivots only. By way of example, in one particular embodiment only one out of every fifteen swing arm assemblies is directly power actuated. More particularly, 120 swing arm assemblies are spaced 1.5 meters (five feet) apart along an intermediate form assembly 214 which is 180 meters (600 feet) in length. Most of the swing arms are passive such as the representative swing arm 320, while every fifteenth swing arm is directly actuated, such as the representative swing arm 318. Accordingly, there are eight directly actuated swing arms such as the swing arm 318, with 22.5 meter (75 feet) spacing.

To actually raise and lower the intermediate form 214, the swing arms such as 318 and 320 are pivotally attached at their upper ends 336 and 338 to the intermediate form 214. More particularly, "C" section members 340 (see also FIG. 17) extend horizontally between the intermediate form lower sections 222 and 224, being secured at either end to respective end brackets 342 and 344. Slotted pivot links 346 and 348 are welded to the horizontal "C" section members 340, with the slots receiving pivot pins 350 and 352. The purpose of the slots in the pivot links 346 and 348 is to accommodate thermal expansion along the length of the intermediate form 214. Preferably, a set of pivot links (not shown) at the longitudinal midpoint of the intermediate form 214 has round apertures, thereby establishing a reference point from which thermal expansion and contraction occurs longitudinally in both directions.

Lateral or transverse movement of the center form assembly 214 is effected by means of transverse shifter arms 354 which, as may be seen from FIGS. 20 and 21, are fixed to each of the swing arm assemblies. As may best be seen in FIG. 20, the pivotal attachments 324 and 326 for the representative swing arms 318 and 320, as well as the pivotal attachment 334 for the representative hydraulic cylinder 322, permit transverse or lateral movement of all the swing arm assemblies and the intermediate form 214. A particular feature of the casting bed embodiment 200 described beginning with reference to FIG. 12 is that lateral movement of the movable section 202 away from the fixed section 204 under the urging of the hydraulic cylinders 292 (FIGS. 16 and 18) automatically produces lateral movement of the intermediate form assembly 214 by means of the transverse shifter arms 354 and lost motion linkages 356 carried by the movable section 202.

Referring in particular to FIG. 21, a representative lost motion linkage 356 includes a downwardly extending element 358 and a bracing member 360 carried by the support structure 300 of the movable casting bed section 202. In FIG. 21, the configuration when the hydraulic cylinder piston rod 294 (FIG. 18) is fully extended and the lips 248 and 250 of the pallets 210 and 212 are in abutment is shown in solid lines, while the configuration when the hydraulic cylinder piston rod 294 is retracted and the movable casting bed section 202 is moved transversely away from the fixed bed section 204 is shown in phantom lines, with identical elements denoted by primed reference numerals.

More particularly, the lower portion of the element 358 is apertured at 362, and the transverse shifter arm 354 extends therethrough. An engagement element 364, is adjustably affixed near the end of the transverse shifter arm 354 so as to be engaged by the downwardly extending element 358 part way through the lateral movement of the casting bed section 202 away from the casting bed section 204 at the urging of the hydraulic cylinder 292.

The operation of the lost motion linkage 356 will now be described beginning with the configuration illustrated in solid lines in FIG. 21 where the casting bed pallet lips 248 and 250 are in abutment, the piston rod 294 (FIG. 18) is fully extended, and the intermediate form assembly is in the lowered position shown in FIG. 18. By way of example, and without limiting the scope of the invention, the width of the intermediate form assembly 214 between the points of engagement with the lips 248 and 250 may be 40 centimeters (15.75 inches) (FIG. 12 configuration). When the movable section 202 is fully away from the fixed section 204, there is a gap of 5 centimeters (2 inches) on each side of the intermediate form assembly 214 (FIGS. 13 and 14 configuration). Thus the total transverse movement of the movable section 202 from the single wide bed configuration of FIG. 15 to the fully-away configuration is 50 centimeters (19.75 inches).

As the piston rod 294 initially retracts, the only movement is transverse movement of the movable bed 202 away from the fixed bed 204. During this initial movement, the transverse shifter arms 354 attached to the swing arm assemblies 318 and 320 do not move, with the apertures 362 at the end of the downwardly extending elements 358 sliding freely along the transverse shifter arms 354. After the movable casting bed section 202 has moved through 45 centimeters of its 50 centimeter (19.75 inch) travel, the downwardly extending element 358 engages the engagement element 364, to begin lateral movement of the transverse shifter arms 354. This lateral movement of the transverse shifter arms 354, which results in identical lateral movement of the swing arm assemblies 318 and 320 and the intermediate form assembly 214, is 5 centimeters (2 inches). At this point, the configuration of FIG. 14 is reached, wherein the intermediate form assembly 314 may be raised by actuating the hydraulic cylinders 322 (FIG. 19).

After the intermediate form assembly 214 has been raised, the cylinders 292 are again operated to extend the piston rods 294 by 10 centimeters (4 inches), resulting in the configuration of FIGS. 12 and 18.

To go from the configuration of FIGS. 12 and 18 to the configuration of FIG. 13, the hydraulic cylinder 292 is operated to retract the piston rod 294 its final 10 centimeters of movement. During the first 5 centimeters of this movement, the intermediate form assembly 214 normally remains adjacent the fixed casting bed section 204, although it is possible that greater adhesion with the cast concrete member 206 carried on the pallet 210 of the movable casting bed section 202 would initially cause the center form assembly 214 to move with the movable bed 202. However, assuming that the center form assembly 214 remains with the fixed casting bed section 204, during the first 5 centimeters of movement of the casting bed section 202 the lost motion linkage 356 allows transverse shifter arms 354 to remain stationary. For the final 5 centimeters of lateral movement of the casting bed section 202, the lost motion linkage 356, and particularly the elements 358 and 364 thereof, engage, pulling the transverse shifter arm 354 and causing lateral movement of the intermediate form assembly 214.

In the event the intermediate form assembly 214 initially remains adhered to the movable bed section 202 and was pulled away from the fixed casting bed section 204, the limit of travel of the sliding pivot assemblies 324, 326 and 334 is reached after 5 centimeters (2 inches), stopping lateral movement of the intermediate form assembly 214. The movable casting bed section 202 then continues on for the final 5 centimeters (2 inches) of lateral movement.

Figure 22:
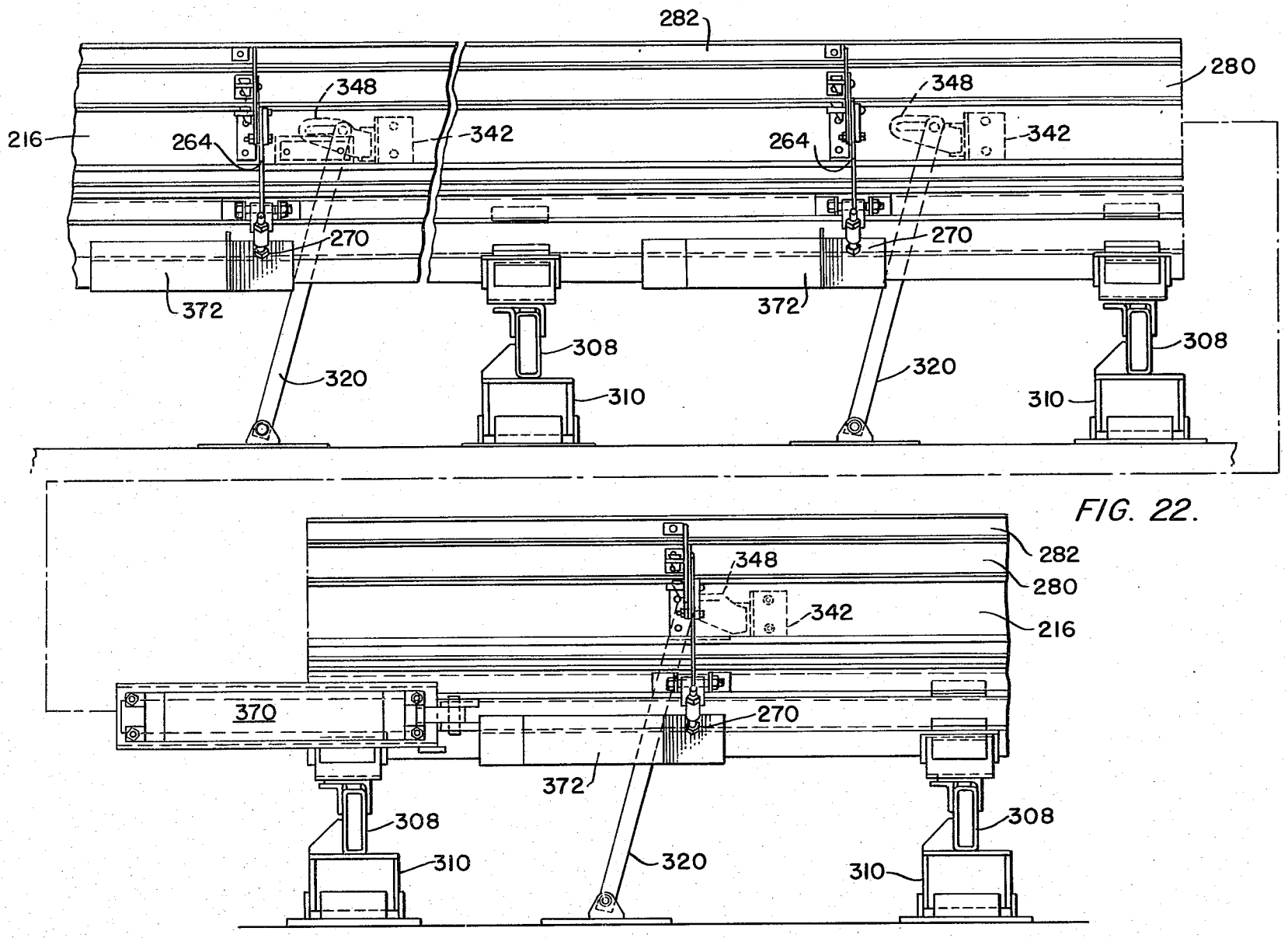
FIG. 22 is a side elevation taken along line 22—22 of FIG. 16 showing details of the left side form assembly in the embodiment of FIGS. 12-21.

With reference now to FIG. 22, the left side form 216 is illustrated, together with the extended cam actuator 276. An hydraulic cylinder 370 is arranged to longitudinally move the extended cam actuator 276, and thereby effect pivotal movement of the triangular actuator 264 (FIGS. 16 and 18) and the side form 214 as wider surface portions 372 of the extended cam actuator 276 engage the sliding cam members 270 in the manner described above with respect to the previous embodiments.

From the foregoing, it will be apparent that the present invention provides a highly flexible and cost efficient combination concrete bed casting apparatus for manufacturing concrete structural members in at least two different widths. This leads to optimum efficiency in operation by permitting single relatively wider slab sections to be produced where the sections are to be cut into relatively shorter lengths which may be lifted by the available crane capacity, and which produces two relatively narrower slabs simultaneously where longer finished lengths are required which would otherwise exceed the crane capacity of an associated lifting crane.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A combination bed casting aparatus for casting either a single elongated concrete structural member in a single elongated casting bed section or for simultaneously casting two elongated concrete structural members in side-by-side parallel elongated casting bed sections comprising a longitudinally extending bottom wall form and oppositely disposed side wall forms, the bottom wall form being divided longitudinally into two supporting sections for supporting the structural member(s) to be cast, the two sections adapted to be positioned in abutting relationship to form with said side wall forms the single casting bed section and spaced from each other by an elongated intermediate wall form, first means for positioning said sections and second means for positioning the intermediate wall form between said two supporting sections and generally parallel to the side wall forms to form with each supporting section and an associated side wall form the side-by-side casting bed sections, said supporting sections and its associated side wall form being moveable transversely to the longitudinal axis of the casting apparatus wherein said second means comprises a lifting mechanism for pivotally positioning the intermediate form by the lifting mechanism in a first position below said moveable section when said two supporting sections are positioned in abutting relationship for forming the single casting bed section and in a second position above and between said supporting sections when said one of the two supporting sections and its associated side wall forms have been moved transversely to form the side-by-side casting bed sections.

2. A combination bed apparatus set forth in claim 1, wherein said intermediate wall form is connected to a transverse shift mechanism supported to a moveable supporting section for affecting movement of said intermediate support transversely of the longitudinal axis of the casting apparatus together with transverse movement of the moveable supporting section.

3. A combination bed apparatus as set forth in claim 2, wherein the movable supporting section is connected to a shifter mechanism having a lost motion linkage which causes said shifter mechanism to be engaged for travel with said moveable section only during a portion of the travel of said moveable section during transverse movement thereof.

4. Apparatus according to claims 2 or 3 wherein one of the two supporting sections is immovably fixed relative to the ground and the other supporting section is moveable relative to the fixed section, said moveable section being supported on a sliding assembly and said first means comprises hydraulic actuating means connected to said sliding assembly for effecting transverse movement of the moveable supporting section.

5. Apparatus according to claim 2, further comprising:

a plurality of spaced transverse tracks disposed below said casting bed apparatus perpendicular to the longitudinal axis of said bed;

roller means mounted to the underside of said moveable section(s) and in rolling engagement with said transverse tracks for supporting said section(s) during transverse movement.

6. Apparatus according to claim 5, including an actuating means for transversely moving said casting bed sections wherein said actuating means comprises:

an elongated actuator element extending below and along substantially the entire length of said casting bed and mounted for longitudinal movement along the longitudinal axis of said casting bed;

at least one swing arm extending between said elongated actuator element and at least the said moveable supporting section(s), said swing arm being pivotally attached to said elongated actuator element and to said moveable supporting section(s) at laterally spaced points; and hydraulic actuator means for longitudinally moving said actuator element to produce a resultant transverse movement of said moveable section(s).

7. Apparatus according to claim 6, wherein said elongated actuator element extends along substantially the center of said casting bed, and a plurality of swing arms extend laterally and symmetrically from said actuator element to both of said supporting sections.

8. Apparatus according to claim 5, wherein said spaced transverse tracks are permanently fixed relative to the ground.

9. Apparatus according to claims 2, 3, 4, 5 or 6 further comprising:

a plurality of vertical swing arms pivotally attached between said intermediate wall form and a plurality of anchor members fixed relative to the ground such that longitudinal movement of said intermediate wall form produces a resultant vertical movement of said intermediate form; and said second means comprising hydraulic actuator means for longitudinally moving said intermediate form.

10. Apparatus according to claim 9, wherein said hydraulic actuator means is connected to said intermediate form.

11. Apparatus according to claim 9, wherein said hydraulic actuator means is connected to the vertical swing arms.

12. Apparatus according to claim 9, wherein said vertical swing arms are attached to said intermediate wall form by slotted pivot links to accommodate thermal expansion along the length of the form.

13. A combination bed casting apparatus for casting either a single elongated concrete structural member in a single elongated casting bed section or for simultaneously casting two elongated concrete structural members in side-by-side parallel elongated casting bed sections comprising a longitudinally extending bottom wall form and oppositely disposed side wall forms, the bottom wall form being divided longitudinally into two sections for supporting the structural member(s) to be cast, the two sections adapted to be positioned in abutting relationship to form with said side wall forms the single casting bed section and spaced from each other by an elongated intermediate wall form, means for positioning said intermediate wall form between said two supporting sections and generally parallel to the side wall forms to form with each supporting section and an associated side wall form the side-by-side casting bed sections, said supporting sections and its associated side wall form being moveable transversely to the longitudinal axis of the casting apparatus, said means for positioning said intermediate wall form including an elongated actuator element disposed beneath said bottom wall and adapted for movement along the longitudinal axis of the casting bed and a plurality of swing arms extending laterally from the actuator element and being connected to said supporting sections, a plurality of lift arms extending upwardly and being connected to the intermediate wall form, first actuating means adapted to energized to move said actuator element, and second actuating means adapted means adapted to be energized to pivotally swing said intermediate form by said lift arms between a first position below said supporting sections while said two supporting sections are drawn into abutting relationship for forming the single casting bed section and a second position above and between said supporting sections while said supporting sections and their associated aide wall forms have been moved transversely to form the side-by-side casting bed sections.

14. A combination bed apparatus set forth in claim 13, wherein said intermediate form is pivotally attached to the swing arms.

15. Apparatus according to claim 13 or 14 wherein said first and second means are hydraulic actuating means.

16. Apparatus according to claim 13 further including a plurality of spaced transverse tracks disposed below said casting bed apparatus perpendicular to the longitudinal axis of said bed; and roller means mounted to the underside side of said moveable sections and in rolling engagement with said transverse tracks for supporting said sections during transverse movement.

17. Apparatus according to claim 13 wherein said elongated actuator element extends along substantially the center of said casting bed, and said plurality of swing arms extend laterally and symmetrically from said actuator element to both of said supporting sections.

18. Apparatus according to claim 13 wherein said plurality of lift arms are pivotally attached between said intermediate wall form and a plurality of anchor members fixed relative to the ground such that longitudinal movement of said intermediate wall form produces a resultant vertical movement of said intermediate form.

19. Apparatus according to claim 18, wherein said lift arms are attached to said intermediate wall form by slotted pivot links to accommodate thermal expansion along the length of the form.

20. Apparatus according to claim 18 wherein said anchor members are centrally disposed beneath said supporting sections and have passageways through which the actuator element freely passes.

* * * * *

UNITED STATES PATENT AND TRADEMARK OFFICE

CERTIFICATE OF CORRECTION

PATENT NO. : 4289293

DATED : September 15, 1981

INVENTOR(S) : Jerry L. CASHION

It is certified that error appears in the above-identified patent and that said Letters Patent are hereby corrected as shown below:

Claim 6, Column 17, line 11, delete "5" and substitute --4--.

Claim 13, column 18, line 26, after "adapted to" insert --be--.

Claim 13, column 18, line 28, delete "means adapted" second occurrence.

Signed and Sealed this

*Fifteenth* Day of *December 1981*

[SEAL]

*Attest:*

GERALD J. MOSSINGHOFF

*Attesting Officer*

*Commissioner of Patents and Trademarks*